US005737661A

United States Patent [19]

Nakai et al.

[11] Patent Number: 5,737,661

[45] Date of Patent: Apr. 7, 1998

[54] APPARATUS FOR PROCESSING PHOTOSENSITIVE MATERIAL

[75] Inventors: Tsutomu Nakai; Takuya Tsujita, both of Wakayama, Japan

[73] Assignee: Noritsu Koki Co., Ltd., Wakayama, Japan

[21] Appl. No.: 632,438

[22] PCT Filed: Sep. 7, 1995

[86] PCT No.: PCT/JP95/01780

§ 371 Date: Apr. 23, 1996

§ 102(e) Date: Apr. 23, 1996

[87] PCT Pub. No.: WO96/08748

PCT Pub. Date: Mar. 21, 1996

[30] Foreign Application Priority Data

| | | | |
|---|---|---|---|
| Sep. 13, 1994 | [JP] | Japan | 6-219134 |
| Sep. 21, 1994 | [JP] | Japan | 6-226854 |
| Sep. 21, 1994 | [JP] | Japan | 6-226855 |

[51] Int. Cl.[6] ..... G03D 3/08

[52] U.S. Cl. ..... 396/615

[58] Field of Search ..... 354/319–321, 354/339; 396/615, 612

[56] References Cited

U.S. PATENT DOCUMENTS

| | | | |
|---|---|---|---|
| 4,903,064 | 2/1990 | Kogane et al. | 354/321 |
| 5,134,430 | 7/1992 | Koizumi | 354/320 |

FOREIGN PATENT DOCUMENTS

| | | |
|---|---|---|
| 1-201662 | 8/1989 | Japan . |
| 1-205165 | 8/1989 | Japan . |
| 3-267935 | 11/1991 | Japan . |

*Primary Examiner*—D. Rutledge

*Attorney, Agent, or Firm*—Armstrong, Westerman Hattori, McLeland & Naughton

[57] ABSTRACT

A photo-processing apparatus comprising at least a developing part for developing a photographic paper to which an image recorded on a developed photographic film is printed and a drying part for drying the developed photographic paper by the developing part. The apparatus includes a guide width synchronizing mechanism for synchronizing the width movement of a pair of guides being located between a guide width changing mechanism installed to a rack part for guiding the photographic paper in the developing part and the drying part, respectively, so as to adjust the spacing of a pair of the guides for guiding both side edges of the photographic paper. There can be provided an apparatus for processing photosensitive material which can precisely set the guide width of the rack for guiding conveyance of the photographic paper and which is easy to maintain and at the same time is inexpensive.

4 Claims, 4 Drawing Sheets

APPARATUS FOR PROCESSING PHOTOSENSITIVE MATERIAL

TECHNICAL FIELD

The present invention relates to an apparatus for processing photosensitive material (hereinafter referred to the "photo-processing apparatus"). More particularly, it relates to a photo-processing apparatus equipped with a rack part which guides and transfers photosensitive material (hereinafter referred to the "photographic paper") in the development part of the photo-processing apparatus.

BACKGROUND ART

A conventional photo-processing apparatus comprises, as shown in FIG. 4, a printing part 103 for printing images of a developed photo film F by an exposure mechanism 102 after pulling out the photographic paper 5 wound around a magazine 101 in the form of a roll, a developing part 104 for passing the photographic paper S printed by the printing part 103 in various processing tanks for development, a drying part 105 for drying the developed photographic paper S by the developing part 104, and a print-cutting part 106 for separating the photo print P of the photographic paper S dried by the drying part for each image. To the developing part 104 and the drying part 105, a submerged rack part 107 for guiding and transferring the photographic paper S and a drying rack part 108 are mounted. To each of the rack parts 107 and 108, a guide width changing mechanism is equipped for adjusting, for example, the spacing between a pair of guides for guiding both side edges of the photographic paper S with a feed screw shaft in which threads of opposite direction to each other are formed.

A conveyor drive of the photographic paper S in the developing part 104 is operated by a photographic paper detection sensor using a photo sensor or a limit switch just before the photographic paper S enters the submerged rack part 107 and is stopped after the photographic paper S is sent out to the drying part 105 via each processing tank and the last photo print P is cut off at the print-cutting part 106. If the conveyor drive is desired to be operated in other occasions such as at the time of inspection of the conveyor mechanism, the conveyor drive is forcibly operated by a key operation on the control panel. In addition, when maintenance is carried out for a guide in width change of the submerged rack part 107 or drying rack part 108, forced conveyor drive is carried out.

However, because a guide width changing mechanism is equipped, to the submerged rack part 107 and the drying rack part 108, respectively, the number of parts such as driving motors increases, giving rise to a problem of high equipment costs. The feed screw shaft must be rotated and the width of a pair of guides must be adjusted (set) individually in accordance with the width size of the photographic paper S.

As a result, there are problems that maintenance and inspection works are troublesome, and an error is likely to occur in the setting of the submerged rack part 107 and the drying rack part 108. Thus, for example, if the guide width is narrower than the normal setting in the drying rack part 108, the photographic paper S is unable to be transferred from the submerged rack part 107 to the drying rack part 108 and photographic paper S is jammed.

If the photographic paper S is jammed in the rack part in the photo-processing apparatus, the rack part is detached, the portion at which the photographic paper S is jammed is confirmed, and the jammed photographic paper is removed.

However, the rack part is, in general, mounted in several pieces, and photographic paper is sometimes failed to be removed and remains in the rack part. However, the submerged rack part and drying rack part of the conventional photo-processing apparatus have no function of detecting the paper (photographic paper). Consequently, changing the width in the direction to narrow the guide width without knowing the condition that the photographic paper remains in the rack part causes the knob felt heavy in the case of the manual width changing mechanism and the presence of the photographic paper is known, but in the case of the automatic width changing mechanism, the presence of the remaining photographic paper is unable to be detected, and the width changing mechanism is locked by the remaining photographic paper, causing a problem of the secondary trouble such as breakage of peripheral parts (missing teeth of the submerged rack part etc.).

If the width is changed to extend the guide width, the photographic paper comes off from the rack part.

In addition, in the photo-processing apparatus, carrying out developing operation without operating the guide width changing mechanism for a long time at the submerged rack part causes impurities such as crystal substance of the treating liquid to adhere to the surface of the feed screw shaft support or feed screw shaft or inner surface of the nut, and the guide will not move even when the guide width is tried to be changed. Consequently, the submerged rack part must be periodically cleaned, causing a problem of extremely troublesome maintenance. A friction unit is installed to the driving motor to prevent damage of parts caused by the overload, but there is a problem that because the traveling torque of the guide becomes heavy in the same manner due to impurities such as crystal substance, the slip function of the friction unit works to prevent changing of the guide width.

Under these circumstances, an object of the present invention is to provide a photo-processing apparatus which can precisely set the guide width of the rack for guiding conveyance of the photographic paper and which is easy to maintain and at the same time is inexpensive.

A further object of the present invention is to provide a photo-processing apparatus which can precisely discharge the photographic paper remaining inside the rack (hereinafter referred to "initial drive") and can carry out stable width changing operation.

In addition, a still further object of the present invention is to provide a photo-processing apparatus which can constantly maintain the movement of the guide smoothly in the guide width changing mechanism and can simplify maintenance.

DISCLOSURE OF THE INVENTION

A photo-processing apparatus according to the first invention of the present invention comprises at least a developing part for developing a photographic paper to which an image recorded on a developed photographic film is printed and a drying part for drying the developed photographic paper by the developing part, and is characterized in that there is provided a guide width synchronizing mechanism for synchronizing the width movement of a pair of guides being located between a guide width changing mechanism installed to a rack part for guiding the photographic paper in the developing part and the drying part, respectively, so as to adjust the spacing of a pair of the guides for guiding both side edges of the photographic paper.

The guide width synchronizing mechanism is connected to a slide connecting means in the guide width changing mechanism.

The guide width synchronizing mechanism comprises a guide width synchronizing means comprising a plurality of width adjustment rack gears and pinion gears and a driving means which is connected to the pinion shaft.

The guide width synchronizing means in the guide width synchronizing mechanism and the slide connecting means in the guide width changing mechanism are designed to be separable by a projection and recess fitting.

A photo-processing apparatus according to the second invention of the present invention has a rack part comprising a conveyor mechanism for conveying the photosensitive material and a guide width changing mechanism for adjusting the spacing of a pair of guides for guiding both side edges of the photosensitive material, and is characterized in that there are provided an initial driving means for driving the conveyor mechanism only for a specified time and a restricting means for stopping operation of the guide width changing mechanism while the initial driving means is in operation.

In addition, a photo-processing apparatus according to the third invention of the present invention has a rack part for guiding and conveying a photosensitive material to which an image recorded on a developed photographic film is printed, and is characterized in that there is provided a controlling means for moving a pair of guides periodically being connected to a guide width changing mechanism located at the rack part, the mechanism comprising a pair of guides for guiding both side edges of the photosensitive material.

According to the photo-processing apparatus of the first invention, the spacing of guides of the guide width changing mechanisms at the submerged rack part and the drying rack part can be moved in synchronism, respectively, by the guide width synchronizing mechanism. Therefore, setting of the guide width at each rack part is not mistaken.

Because the guide width changing mechanism is designed to be separable by protrusion and recess fitting to the guide width synchronizing mechanism, it is possible to synchronize the relevant guide spacing to the settings only by loading the submerged rack part and drying rack part in the apparatus body.

According to the photo-processing apparatus of the second invention, at the time of building up of power supply, the initial operation of the conveyor mechanism takes place for a specified time after the operation of the guide width changing mechanism is stopped by the restricting means. Consequently, because the guide width is changed after the photographic paper remaining in a rack part, for example, in the submerged rack part or drying rack part, is precisely sent out, no damage of parts caused by photographic paper occurs.

In addition, according to the photo-processing apparatus of the third invention, because a pair of guides are periodically and automatically moved, impurities of the developing liquid can be prevented from adhering to the feed screw shaft for moving the guide. As a result, guide width changing operation can smoothly take place. In addition, maintenance such as rack cleaning can be simplified.

BEST MODE FOR CARRYING OUT THE INVENTION

Figure 1:
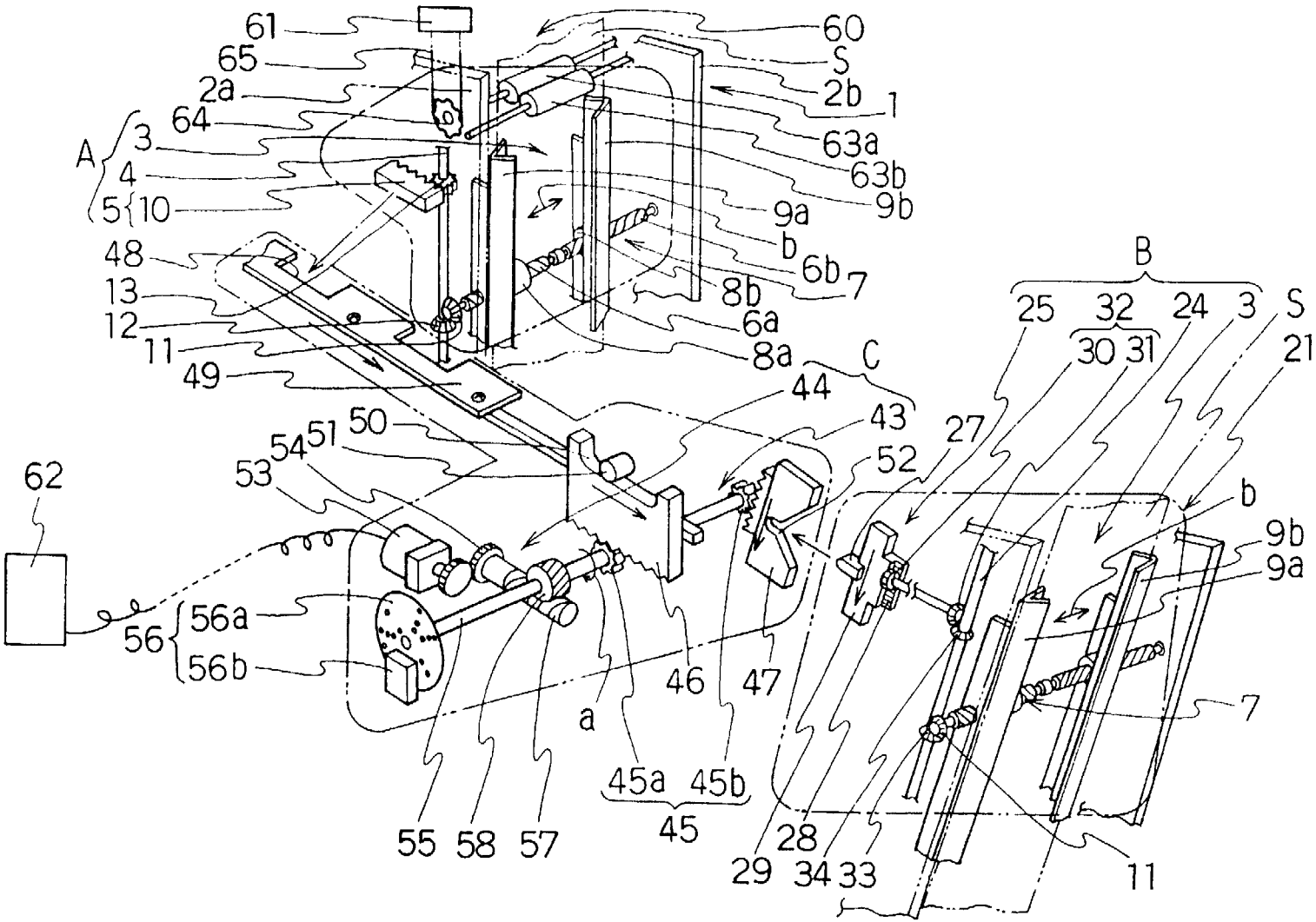
FIG. 1 is a schematic perspective view showing one embodiment of a photo-processing apparatus according to the first and the second inventions.
Figure 2:
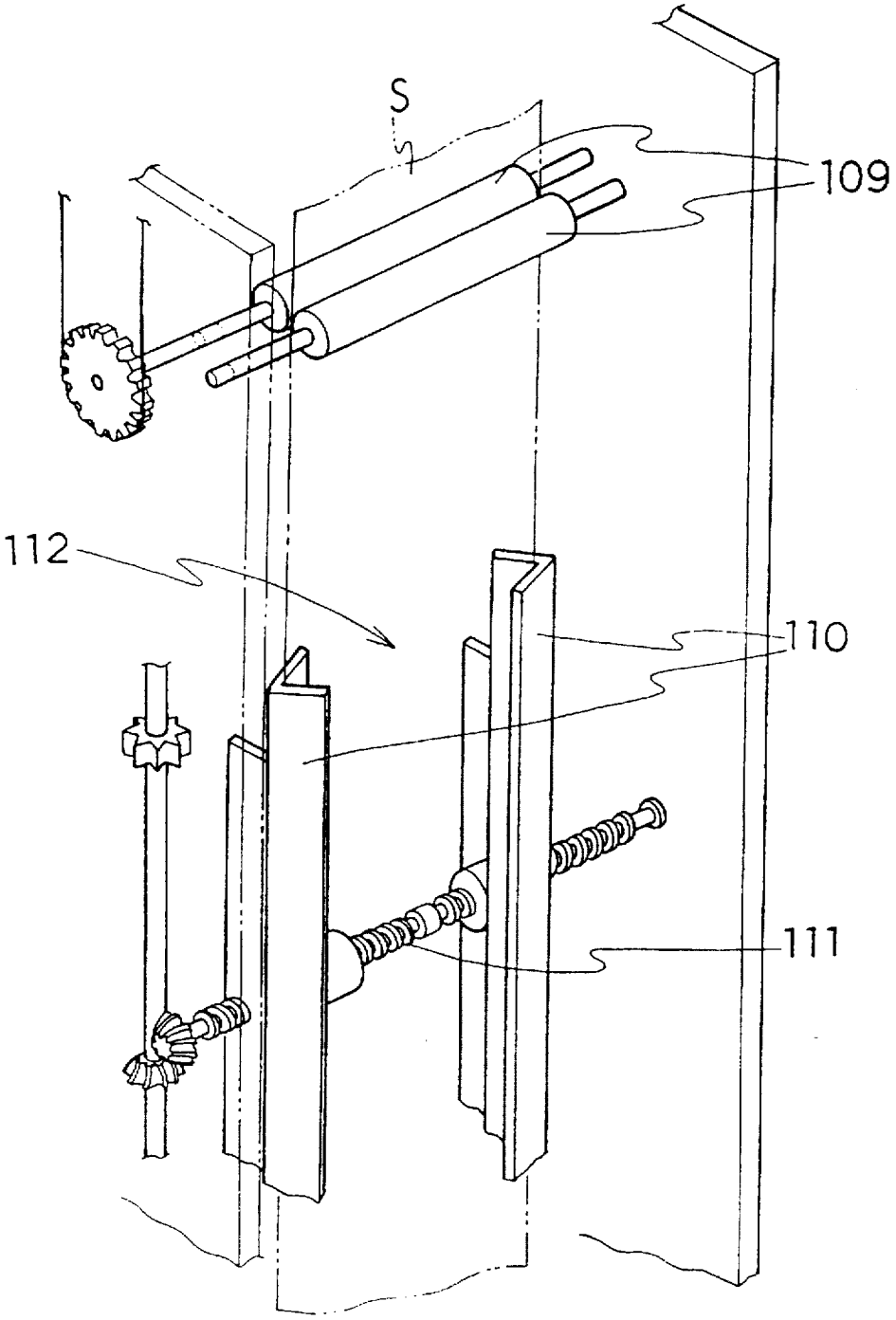
FIG. 2 is an explanatory view showing the rack part of the photo-processing apparatus of FIG. 1.

Referring now to the drawings, a photo-processing apparatus according to the present invention will be described in detail hereinafter.

FIG. 1 is a schematic perspective view showing one embodiment of a photo-processing apparatus according to the first and the second inventions.

The photo-processing apparatus according to this embodiment comprises a developing part for passing a photographic paper printed with the image recorded on the developed photographic film through various treating tanks for development and a drying part for drying the photographic paper developed at the developing part.

To the inside of each treating tank of the developing part and the drying part, as shown in FIG. 1, a submerged rack part 1 for guiding and transferring the photographic paper S and a drying rack part 21 are installed.

Further, to this submerged rack part 1, a guide width changing mechanism A comprising a guide width changing means 3 located between a pair of side plates 2*a*, 2*b* mounted upright and a first slide connecting means 5 to be connected to the guide width changing means 3 via a first transmission shaft 4 is equipped.

The guide width changing means 3 comprises a feed screw shaft 7 installed to a pair of side plates 2*a*, 2*b* and with male threads 6*a*, 6*b* formed on both sides in the direction reversal to each other; nuts 8*a*, 8*b* screw-fitted to the male threads 6*a*, 6*b* of the feed screw shaft 7; and a pair of guides 9*a*, 9*b* with a doglegged cross section mounted to the nuts 8*a*, 8*b*. Rotating the feed screw shaft 7 in the normal or reverse direction can widen or narrow the spacing (guide width) of the one pair of guides 9*a*, 9*b* to adjust to the width size of the photographic paper S.

The first slide connecting means 5 comprises a rack gear 10.

The first transmission shaft 4 is built upright rotatably in the submerged rack part 1, and to the lower part thereof, a bevel gear 12 engaged with the bevel gear 11 which is formed on the feed screw shaft 7 is formed, while to the upper part thereof, a pinion gear 13 engaged with the rack gear 10 is formed. With this first transmission shaft 4, the horizontal movement of the first slide connection means 5 can be transmitted to the guide width changing means 3 as a rotary movement.

On the other hand, to the drying rack part 21, a guide width changing mechanism B comprising a guide width changing means 3 similar to the submerged rack part 1 and the second slide connection means 25 connected to the guide width changing means 3 via the second transmission shaft 24 are equipped.

The second slide connection means 25 comprises a slide rack gear 29 with a protruded piece 27 formed on one side and teeth 28 on the other side and a rotating shaft 32 with a pinion gear 30 to be engaged with the teeth 28 formed on one end and a bevel gear 31 on the other end.

The second transmission shaft 24 is mounted upright rotatably in the drying rack part 21, and to the lower part thereof, a bevel gear 33 engaged with the bevel gear 11 formed on the feed screw shaft 7 is formed, and to the upper part thereof, a bevel gear 34 engaged with the bevel gear 31 of the rotary shaft is formed.

Between the guide width changing mechanisms A, B in the developing part and drying part, a guide width synchronizing mechanism C is equipped to synchronize the width-direction movement of a pair of guides 9*a*, 9*b* for guiding both side edges of the photographic paper S by the guide width changing mechanisms A, B.

The guide width synchronizing mechanism C is connected to the first slide connection means 5 and the second slide connection means 25, respectively, in the guide width changing mechanisms A, B.

The guide width synchronizing mechanism C comprises a guide width synchronizing means 43 and a driving means 44 for driving the means 43.

The guide width synchronizing means 43 comprises a pinion shaft 45 with two pieces of pinion gear 45*a*, 45*b* formed and width adjusting rack gears 46, 47 engaged with the pinion gears 45*a*, 45*b*, respectively.

The width adjusting rack gear 46 is connected to a slide plate 49 provided with a rectangular notch 48, to which the rack gear 10 is fitted, and at the same time, is guided and supported slidably by a stationary member of the apparatus body, such as that restricting the guide width. To an elongated hole groove 50 formed at the upper end of the rack gear 46, a stopper pin 51 is fitted for preventing the rack gear 46 from traveling outside the allowable range. On the other hand, the rack gear 47 has a recess 52 formed for allowing the protruded piece 27 of the slide rack gear 29 in the second slide connection means 25 to fit into it and at the same time is slidably guided and supported by a stationary member in the manner similar to that described before.

The driving means 44 comprises a width changing motor 53; a friction unit 54 for preventing damage to each part by overload; a detector 56 comprising a detection plate 56*a* connected to an output shaft 55 which is an extension of the pinion shaft 45, and a sensor 56*b*; and a worm 57 and worm wheel 58 for connecting the friction unit 54 and the output shaft 55. The friction unit 54 prevents parts from being damaged by the overload applied when the rack gears 46, 47 try to travel outside the allowable range due to a detection error of the detector 56 and the like.

Consequently, when the spacing between a pair of guides 9*a*, 9*b* of the guide width changing means A, B in the submerged rack part 1 and the drying rack part 21 is extended to a specified dimensional width, the output shaft 55 and the pinion shaft 45 are rotated in the direction a shown in FIG. 1 by the rotation of the width changing motor 53. With this operation, the rotary movement of the motor 53 is converted to a linear movement of slide plate 49 and the rack gear 10 by the pinion gear 45*a* and the rack gear 46. In the submerged rack part 1, this linear movement is converted to the rotary movement again by the first transmission shaft 4 to rotate and drive the feed screw shaft 7 and expands a pair of guides 9*a*, 9*b* in the direction b shown in FIG. 1.

On the other hand, in the drying rack part 21, the rotary movement of the motor 53 is converted to a linear movement of the second slide connection means 25 by the pinion gear 45*b* and the rack gear 47. This linear movement is converted again to the rotary movement by the second transmission shaft 24, rotates and drives the feed screw shaft 7 to expand a pair of guides 9*a*, 9*b* in the direction b shown in FIG. 1. As a result, the photographic paper S transferred from the submerged rack part 1 is not only precisely transferred but also guided by guides 9*a*, 9*b* of the drying rack part 21.

The photo-processing apparatus shown in FIG. 1 is equipped with an initial driving means 61 for driving a conveyor mechanism 60 for transferring the photographic paper S only for a specified time and a restricting means 62 for stopping the operation of the guide width changing mechanisms A, B while the initial driving mechanism 61 is being driven.

The conveyor mechanism 60 comprises a pair of rollers 63*a*, 63*b* installed between a pair of side plates 2*a*, 2*b*; a sprocket 64 mounted at the shaft end of the roller 63*a*; and a chain 65 wrapped around the sprocket 64. The chain 65 is connected to a driving motor not illustrated, and the photographic paper S held between a pair of rollers 63*a*, 63*b* by the driving motor is sent along the pair of guides 9*a*, 9*b*. In this embodiment, the conveyor mechanism 60 employing a pair of rollers 63*a*, 63*b* is adopted, but this invention should not be limited to this, but can be applied to the conveyor mechanism in which rollers are arranged in a zigzag pattern.

For the initial driving means 61, there can be used a timer circuit which is connected to the driving motor and drives a driving motor for a specified time as the power supply is turned on.

For the restricting means 62, an electromagnetic relay or an electronic switch which operates with the output signal of the initial driving timer circuit can be used for turning off the power supply of the width changing motor 53 of the driving means 44.

If CPU is used for controlling the photo-processing apparatus, the software built in the CPU is partly modified so that it outputs the driving motor driving signal for specified time and at the same time outputs the inhibit a signal for inhibiting the drive of the width change motor when the power supply turn-on signal is inputted to CPU at the time of turning up of the power supply.

Furthermore, in the photo-processing apparatus in this embodiment, the guide width synchronizing mechanism C and the guide width changing mechanism A in the submerged rack part 1 are protrusion-recess-connected using the rectangular notch 48 of the slide plate 49 and the rack gear 10. Similarly, the guide width synchronizing mechanism C and the guide width changing mechanism B in the drying rack part 21 are protrusion-recess-connected using a recess 52 of the rack gear 47 and a protruded piece 27 of the second slide connection means 25. Consequently, because the submerged rack part 1 and the drying rack part 21 can be connected to the guide width synchronizing mechanism C equipped in advance only by loading them to the developing part and the drying part of the apparatus, respectively, it is possible to accurately synchronize the width of a pair of guides to the setting of the photographic paper being transferred. After the loading, the submerged rack part 1 or the drying rack part 21 can be easily detached for cleaning or inspection, which is very convenient.

Figure 3:
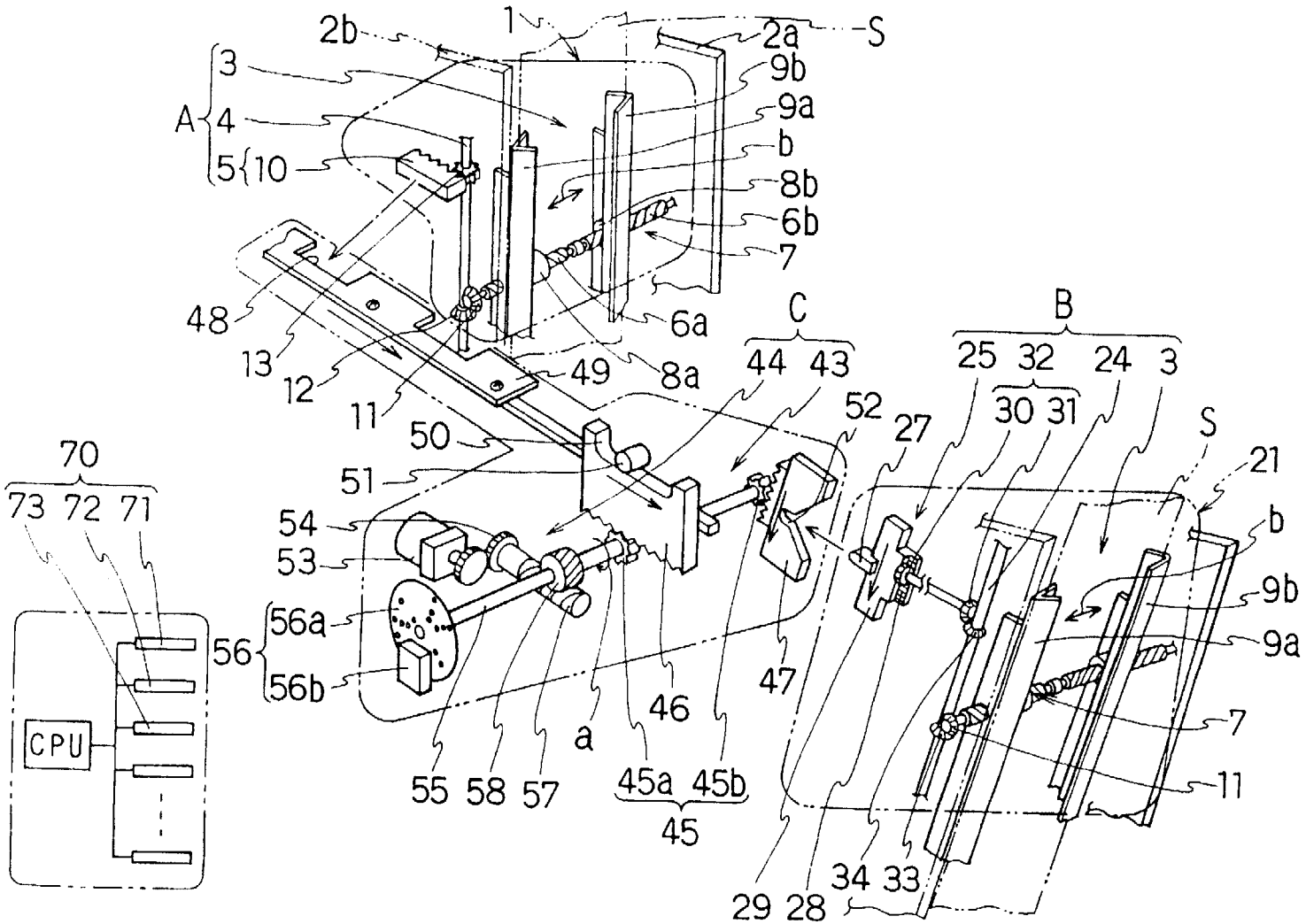
FIG. 3 is a schematic perspective view showing one embodiment of a photo-processing apparatus according to the third invention.
Figure 4:
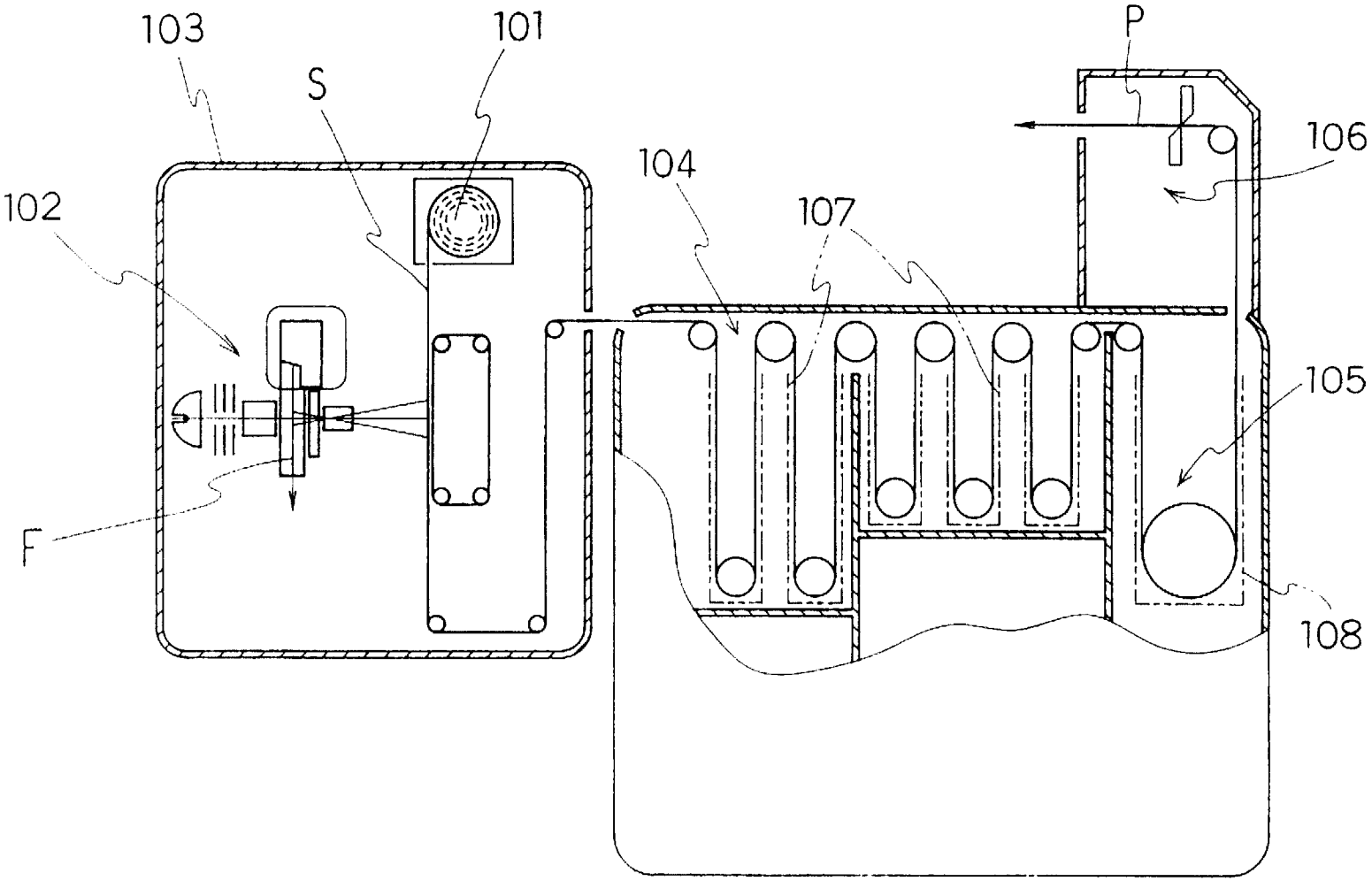
FIG. 4 PRIOR ART
FIG. 4 is an explanatory view showing one example of the photo-processing apparatus.

Referring now to FIG. 3, the photo-processing apparatus according to the third invention will be explained.

FIG. 3 is a schematic perspective view showing one embodiment of the photo-processing apparatus according to the third invention.

The photo-processing apparatus according to this embodiment also comprises a developing part for passing a photographic paper printed with images recorded on a developed photographic film through various treatment tanks for development and a drying part for drying the photographic paper developed by the developing part.

Further, to each treatment tank inside of the developing part and the drying part, as shown in FIG. 3, a submerged rack part 1 for guiding and conveying the photographic paper S and a drying rack part 21 are installed. By the way, to the elements same as those in the embodiment shown in FIG. 1, the same reference numerals are given, and because their configuration and operation are same, explanation thereof will be omitted.

The photo-processing apparatus according to the third invention comprises a controlling means 70 connected to the driving means 44 for periodically moving the pair of guides 9a, 9b.

The controlling means 70 comprises, for example, a timer circuit 71 for operating a width changing motor 53 of the driving means 44 at a specified time; a cycle circuit 72 for setting the frequency of the pair of guides 9a, 9b to reciprocate from the minimum width to the maximum width when the timer circuit is in operation; and an initial driving circuit 73 for driving a conveyor mechanism for a specified time to discharge the remaining photographic paper in the rack.

The controlling means 70 is installed into CPU together with a guide width detection circuit and an emergency stop circuit of a safety device.

Next, explanation will be made on the operation of the controlling means 70 in the photo-processing apparatus according to the third invention.

At first, the development operation is carried out after adjusting the spacing (width) of a pair of guides 9a, 9b in the submerged rack part 1 and the drying rack part 21 in accordance with the width size of the photographic paper S as described above. In general, the development operation is continued without change for several days once the positions of guides 9a, 9b are set.

The operation of the controlling means 70 is carried out in accordance with the following steps (1)–(5).

(1) When the previously specified work time of the day comes, the power supply of the apparatus builds up by the command of the timer circuit 71 of the controlling means 70.

(2) At the time of this building up of the power supply, the normal guide width position is checked, and then by the command of the driving circuit 73, the initial drive takes place. If the width check is error-indicated, the guide width position is modified to the normal position, and, then, the following operation takes place.

(3) By the command of the cycle circuit 72, the width change motor is rotated in the normal and reverse directions and the width is changed by moving the guides 9a, 9b to the minimum width position side (for example, 89 mm) of the photographic paper used, and at the same time, to the maximum width position side (for example, 165 mm), respectively, and then, to the original position of guides 9a, 9b.

(4) After carrying out this operation 2 cycles, that is, two goings and returnings, the normal guide width position is checked again.

(5) After checking, the photographic paper begins to be fed, and normal development operation is undertaken.

Thereafter, because the same operation is carried out at the start of development operation, impurities are difficult to adhere to the feed screw shaft 7. As a result, when the photographic paper with a different width size is replaced, the guide width can immediately be changed and the operability is improved.

In this embodiment, the guide is moved after the initial drive, but it might be moved at the start of operation, at the time of building up of power supply, or when guide width is changed. The operation is designed to repeat two goings and returnings but it might be carried out at least one going and returning.

As described above, according to the photo-processing apparatus according to the first invention, because between the guide width changing mechanisms in the rack parts of the development part and the drying part, a guide synchronizing mechanism is equipped for moving and synchronizing the relevant pairs of guides simultaneously, setting of the guide width of the submerged rack part and the drying rack part is never mistaken. Consequently, it is possible to prevent troubles such as jamming or dislocation of the photographic paper, whereby enabling stable conveying of the photographic paper.

Because the guide width synchronizing mechanism comprises a guide width synchronizing means comprising a pinion shaft on which two pinion gears are formed and two width adjusting rack gears; and a driving means comprising a width change motor and a detector, the number of parts is reduced and the construction is simple, resulting in reduced equipment costs.

In addition, the submerged rack part of the development part and the drying rack part of the drying part can be mounted and detached to and from the guide width synchronizing mechanism using the slide connection means, respectively. Consequently, only by loading the submerged rack part and the drying rack part onto the apparatus body, the width of a pair of guides can be synchronized to the setting, thereby improving maintainability and workability.

According to the photo-processing apparatus according to the second invention, even if the photographic paper remains in the rack part after trouble such as clogging is disposed of, the paper is discharged at the time of building-up of the power supply, and no secondary trouble caused by breakage of parts occurs at the time of changing the guide width.

In addition, according to the photo-processing apparatus according to the third invention, because a pair of guides are periodically moved by the controlling means connected to the guide width changing mechanism, even when development operation of the photographic paper is not carried out, it is possible to prevent adhesion of impurities such as crystal substance to the feed screw shaft and the like. As a result, it is possible to suppress the increase of the moving torque of guides in the guide width changing operation after the photographic paper is changed. In addition, because the frequency of rack cleaning and the like can be reduced, maintenance can be simplified.

INDUSTRIAL APPLICABILITY

The photo-processing apparatus according to the present invention can prevent troubles such as jamming or dislocation of the photographic paper and can stably transfer the photographic paper, and even if the photographic paper remains in the rack part, it is discharged at the start-up of the power supply so that secondary troubles caused by breakage of parts does not occur when the guide width is changed. In addition, because a pair of guides are periodically moved, it is possible to prevent impurities such as crystal substance and the like from adhering to the feed screw shaft and the like, the photo-processing apparatus according to the present invention is useful for a photo-processing apparatus of a type in which the photographic paper is transferred in the rack.

We claim:

1. An apparatus for processing photosensitive material comprising:

at least a developing part for developing a photographic paper to which an image recorded on a developed photographic film is printed;

a drying part for drying said photographic paper, once developed, by said developing part; and a guide width synchronizing mechanism for synchronizing a spacing of two pairs of guides, a first pair of guides being a part of a first guide width changing mechanism installed on a submerged rack part for guiding said photographic paper in said developing part and a second pair of guides being a part of a second guide width changing mechanism for guiding said photographic paper in said drying part, respectively, so as to adjust said spacing of both said pairs of guides for guiding each side edge of said photographic paper and wherein said guide width synchronizing means in said guide width synchronizing mechanism and a first and second slide connecting means in said first and second guide width changing mechanism, respectively, are designed to be separable by a projection and recess fitting.

2. The apparatus of claim 1, wherein said guide width synchronizing mechanism comprises a guide width synchronizing means comprising a plurality of width adjustment rack gears and pinion gears and a driving means which is connected to a pinion shaft.

3. An apparatus for processing photosensitive material having a rack part comprising a conveyor mechanism for conveying the photosensitive material and a guide width changing mechanism for adjusting the spacing of a pair of guides for guiding both side edges of the photosensitive material, characterized in that the apparatus includes an initial driving means for driving the conveyor mechanism only for a specified time and a restricting means for stopping operation of the guide width changing mechanism while the initial driving means is in operation.

4. An apparatus for processing photosensitive material comprising:

a rack part for guiding and conveying a photosensitive material to which an image recorded on a developed photographic film is printed; and a controlling means for moving two pairs of guides, wherein each pair of guides is periodically connected to a first and second guide width changing mechanism, respectively, each of said first and second guide width changing mechanisms comprising a pair of guides for guiding each side edge of said photosensitive material.

* * * * *